US011114767B2

(12) United States Patent
Shahvirdi Dizaj Yekan

(10) Patent No.: US 11,114,767 B2
(45) Date of Patent: Sep. 7, 2021

(54) TILED REFLECTOR FOR FIXED WIRELESS APPLICATIONS

(71) Applicant: Metawave Corporation, Carlsbad, CA (US)

(72) Inventor: Taha Shahvirdi Dizaj Yekan, San Diego, CA (US)

( * ) Notice: Subject to any disclaimer, the term of this patent is extended or adjusted under 35 U.S.C. 154(b) by 0 days.

(21) Appl. No.: 16/687,663

(22) Filed: Nov. 18, 2019

(65) Prior Publication Data

US 2020/0161770 A1 May 21, 2020

Related U.S. Application Data

(60) Provisional application No. 62/768,931, filed on Nov. 18, 2018.

(51) Int. Cl.

| | |
|---|---|
| ***H01Q 15/14*** | (2006.01) |
| ***H01Q 3/46*** | (2006.01) |
| ***H01Q 15/16*** | (2006.01) |

(52) U.S. Cl.

CPC ..... *H01Q 15/147* (2013.01); *H01Q 3/46* (2013.01); *H01Q 15/148* (2013.01); *H01Q 15/167* (2013.01)

(58) Field of Classification Search

CPC ..... H01Q 3/46; H01Q 15/148; H01Q 1/246; H01Q 15/0086; H01Q 3/36; H01Q 15/14; H01Q 21/065; H01Q 3/38; H01Q 19/10; H01Q 19/104; H01Q 19/18; H01Q 3/18; H01Q 7/0413; H01Q 15/147; H01Q 15/167; H01Q 15/168; H01Q 15/142

See application file for complete search history.

(56) References Cited

U.S. PATENT DOCUMENTS

| | | | | |
|---|---|---|---|---|
| 9,583,839 | B2 * | 2/2017 | Liu | H01Q 15/0026 |
| 9,742,074 | B2 * | 8/2017 | Liu | H01Q 19/19 |
| 10,103,434 | B2 * | 10/2018 | Maltsev | H01Q 3/34 |
| 10,218,080 | B2 * | 2/2019 | Polehn | H01Q 1/24 |
| 10,547,116 | B2 * | 1/2020 | Pitsillides | H01Q 15/002 |
| 10,553,947 | B2 * | 2/2020 | Scarborough | H01Q 3/46 |
| 10,594,033 | B1 * | 3/2020 | Black | H01Q 3/443 |
| 2017/0179596 | A1 * | 6/2017 | Diaz | H01Q 19/104 |
| 2018/0020440 | A1 | 1/2018 | Stuck | |
| 2019/0074588 | A1 | 3/2019 | Scarborough et al. | |

OTHER PUBLICATIONS

D. Wang, et. al., "A 60 GHz Passive Repeater Array with End tire Radiation Based on Metal Groove Unit-Cells," 9th European Conference, EuCAP 2015, Lisbon, Portugal, pp. 1-5, 27, Feb. 205.

J. A. Zhang, et al., "Massive hybrid antenna array for millimeter-wave cellular communications," in IEEE Wireless Communications, vol. 22, No. 1, pp. 79-87, Feb. 2015.

* cited by examiner

*Primary Examiner* — Vibol Tan

(74) *Attorney, Agent, or Firm* — Sandra Lynn Godsey

(57) ABSTRACT

Examples disclosed herein relate to a directed reflect array with a tiled configuration for fixed wireless applications. The directed reflect array includes a substrate and a plurality of reflective tiles disposed on the substrate, wherein the plurality of reflective tiles are individually arranged to produce a directed radiation pattern that is directed toward a target reflection point based at least on a reflection phase of one or more reflective tiles in the plurality of reflective tiles. Other examples disclosed herein relate to a method of configuring a directed reflect array and a wireless network system that includes a directed reflect array.

20 Claims, 12 Drawing Sheets

250

TILED REFLECTOR FOR FIXED WIRELESS APPLICATIONS

CROSS-REFERENCE TO RELATED APPLICATIONS

This application claims priority from U.S. Provisional Application No. 62/768,931, titled "METHOD AND APPARATUS FOR A TILED REFLECTOR FOR FIXED WIRELESS APPLICATIONS," filed on Nov. 18, 2018, of which is incorporated by reference herein.

BACKGROUND

Ubiquitous Internet is a current demand and will only increase going forward. Consumers desire wireless networks to deliver these data services directly to their mobile devices and workspaces. A large development in wireless technology is the fifth generation of cellular communications (5G), which encompasses more than the current long-term evolution (LTE) capabilities of the fourth generation (4G) and promises to deliver high-speed Internet via mobile, fixed wireless and so forth. This will require the use of previously unused higher frequency band to increase Internet speeds.

In some of these approaches for 5G, the Internet will connect to an RF transmitter, which then sends signals to one or more receivers. One type of connection and method is referred to as "Fixed Wireless" ("FW"). Compared to a cellular system that broadcasts to many users within an area defined as a cell in the vicinity and range of a base station (BS), an FW system uses remote stations, typically smaller than a traditional BS, to transfer data at high speeds. The FW transmitter acts as a localized satellite, where the transmitters, or FW stations, may be clustered close together. This provides the ability to deliver faster Internet speeds with lower latency than 4G communications. It is possible to expand the coverage area footprint using FW. This is a reliable, cost-effective way to provide the current demand of users while having the potential to reach new and previously unconnected areas of the world.

The use of higher frequencies give the capacity to transform FW into a broadband type solution. The concepts of FW systems may also find use in another type of data delivery, referred to as mobile broadband (MB), which is Internet delivered over the conventional cellular network to a mobile device, such as a cell phone. MB systems are designed for high volume with low bandwidth, and are used for video and Internet streaming as well as for transferring voice data. MB systems are flexible, and are able to cover a large area, or cell, at the cost of losing speed and adding latency.

Both FW and MB may be used to cover the "last hop" or "last mile" from the BS to your device or home. FW receives its connection to the Internet through the cellular system and then sends that data within a building, or between buildings. There are many scenarios that my find the focused, local delivery of the FW systems convenient. These are dedicated wireless connections with low latency. Typically, FW systems require line-of-sight (LOS) delivery, but as these systems expand in use, additional requirements will come in to play.

BRIEF DESCRIPTION OF THE DRAWINGS

The present application may be more fully appreciated in connection with the following detailed description taken in conjunction with the accompanying drawings, which are not drawn to scale and in which like reference characters refer to like parts throughout and wherein.

DETAILED DESCRIPTION

The present disclosure relates to fixed wireless networks and applications, and in particular, passive reflectors within a fixed wireless scheme. Although the present disclosure relates to wireless systems using passive reflectors, the subject technology may include active reflector systems, where a signal is redirected and controlled to achieve other type delivery. The present disclosure provides for methods and apparatuses to FW systems and reflectors to enable high-speed Internet and data transmissions. The reflectors are configured as a reflect array made up of multiple individual tiles to achieve a desired redirection of a received signal. In some implementations the reflect array is made up of a configuration of passive patch antenna tiles, referred to herein as "reflector elements." The reflect array is designed to operate at the higher frequencies utilized in 5G and to operate at relatively short distance. In some instances, FW systems are more secure than conventional high-speed broadband connections, as it uses wireless components that are not typically used for public or open access. In addition, FW system are typically secured by military grade encryption, such as the Advanced Encryption Standard (AES).

The flexibility of FW systems enables any number of configurations. In addition, a FW system may have built-in fail-safe features so that if one transmission path is unavailable, another may be used. In addition, for set up, there may be any number of FW components configured with direct transmission path, or LOS, to a BS or transmitter. The present disclosure also provides for reflectors that direct the signal throughout a given space. In some cases, this may be a single reflection, or deflection, of a received signal to a specific receiver.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, the subject technology is not limited to the specific details set forth herein and may be practiced using one or more implementations. In one or more instances, structures and components are shown in block diagram form in order to avoid obscuring the concepts of the subject technology. In other instances, well-known methods and structures may not be described in detail to avoid unnecessarily obscuring the description of the examples. Also, the examples may be used in combination with each other.

Figure 1:
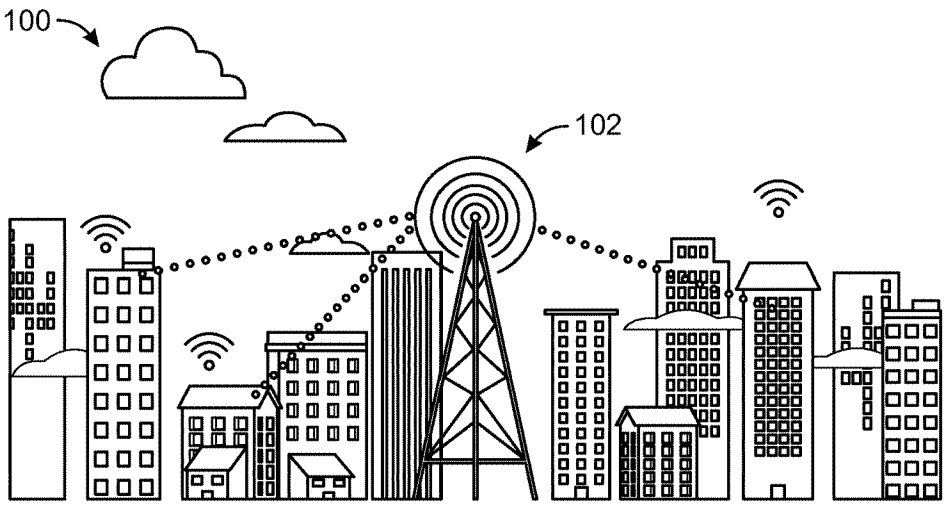
FIG.1 (Prior Art)
FIG. 1 illustrates an example of a conventional omnidirectional wireless system.

FIG. 1 illustrates a conventional communication system, such as a cellular network, having a central antenna with omni-directional radiation over a specific area, sometimes referred to as a cell. In environment 100, the antenna 102 sends radiation signals over a large area with an omni-directional-type radiation pattern. As illustrated, there are other transmissions occurring within this environment. A goal of new systems, and in particular 5G systems with the high throughput and focused capacity requirements, is to focus energy in a specific direction and so be able to direct the communication signals to a specific location.

Figure 2:
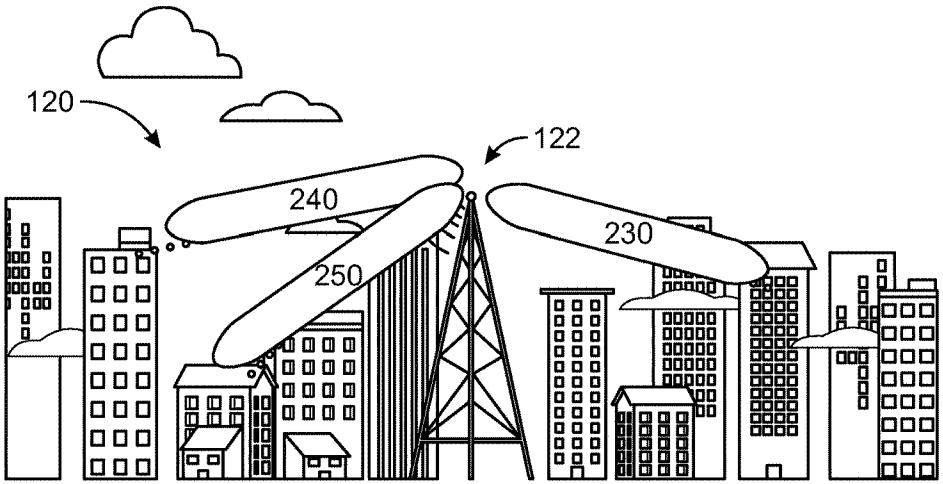
FIG. 2 illustrates a directed wireless system, according to implementations of the subject technology.

As illustrated in FIG. 2, in a similar environment 120, a central antenna, such as a base station 122 (BS) may provide directed radiation patterns 230, 240, 250 and so forth to the various specific locations within the environment 120. These directed beams may then be redirected within various areas to enable communications to individual mobile devices as well as to create effective small cells using FW components and reflect arrays.

Figure 3:
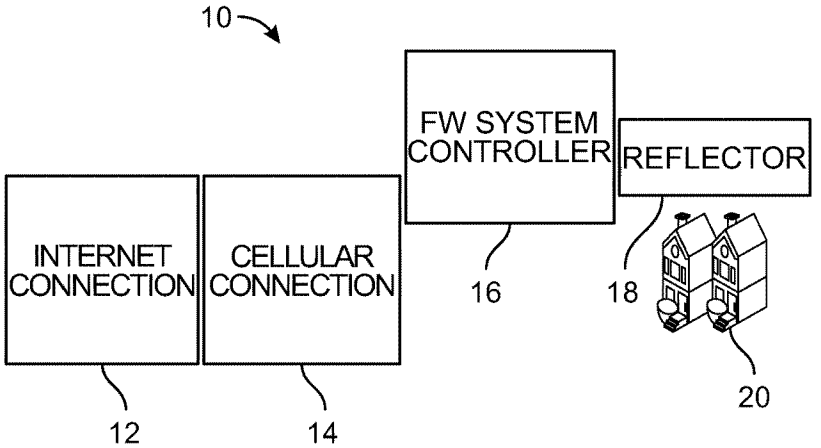
FIG. 3 illustrates participant units in a directed wireless system, according to implementations of the subject technology.

FIG. 3 illustrates participant units in a directed wireless system 10 as illustrated in FIG. 2, having a target coverage area 20 that is provided with wireless communications by an Internet connection module 12. The directed wireless system 10 may connect directly to the Internet connection module 12, such as from Internet connection module 12 to FW system controller 16 or may connect via a cellular connection module 14. The directed wireless system 10 includes at least one positioned reflector 18 for providing signals to the target coverage area 20. In some implementations, the directed wireless system 10 may provide directed radiation patterns, beams, omni-directional beams, or a combination of both and other types of radiation for a given area.

Figure 4:
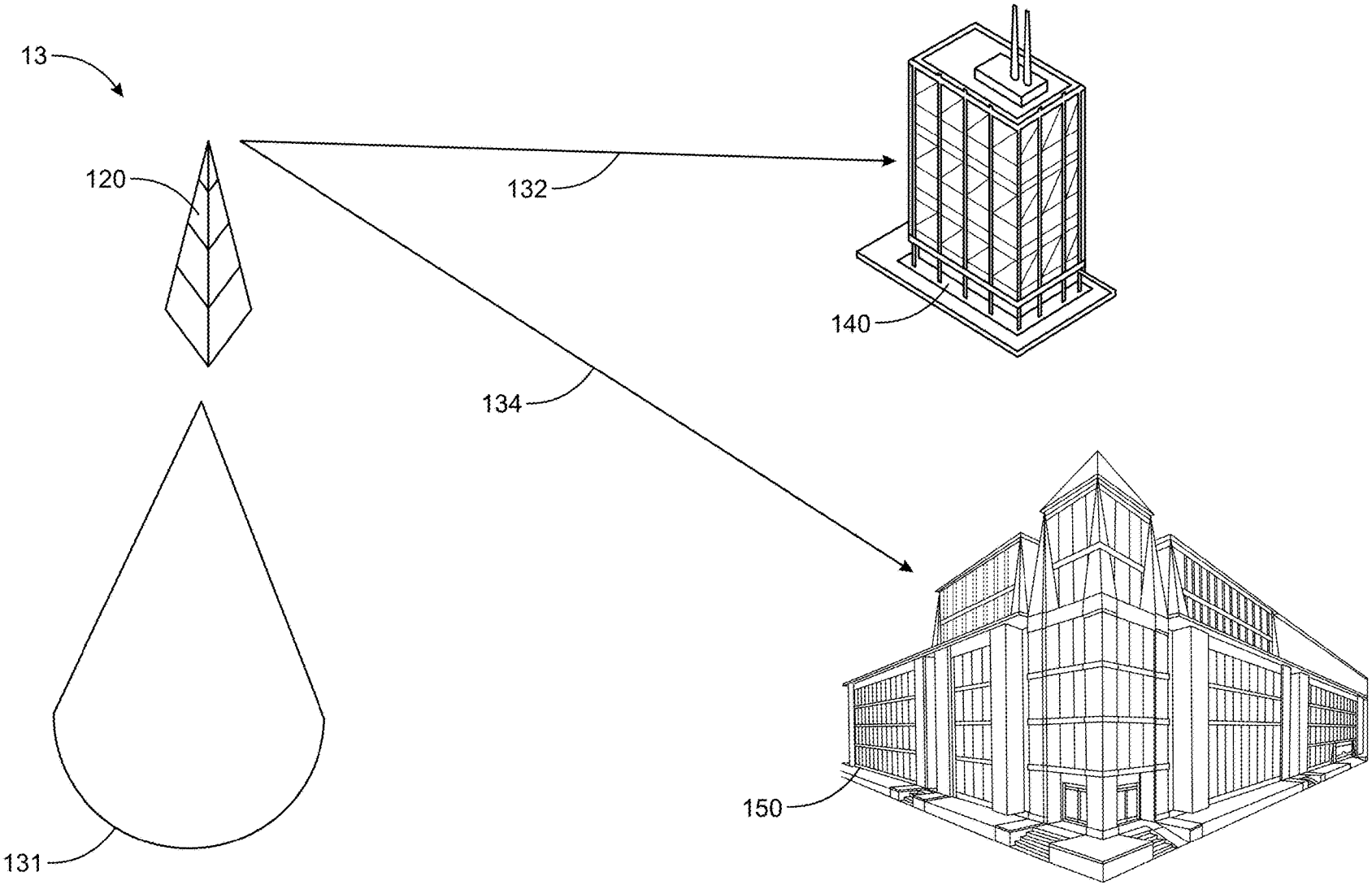
FIG. 4 illustrates operation of a directed wireless system, according to example implementations of the subject technology.

FIG. 4 illustrates a FW system 13 having an antenna, or BS, 120 with three different radiation patterns (e.g., 131, 132, 134). A first beam 132 is directed to a first building 140 and a second beam 134 is directed to a second configuration of buildings 150. This configuration enables the target areas, 140, 150, to have reflect arrays therein to direct the beams 132, 134 in one or more areas within these areas 140, 150, respectively. Such configurations enable directed beams to focus energy in the desired areas. For example, in a shopping mall within area 150, the FW system 13 communicates with the BS 120 and directs these beams throughout the shopping mall to areas of high cellular use, such as in a coffee shop or food court area. Specific stores may also desire directed communications to enable shoppers to use the Internet of Things (IoT) to purchase items, find information about items, and so forth. There are any number of uses for a FW system.

Figure 5:
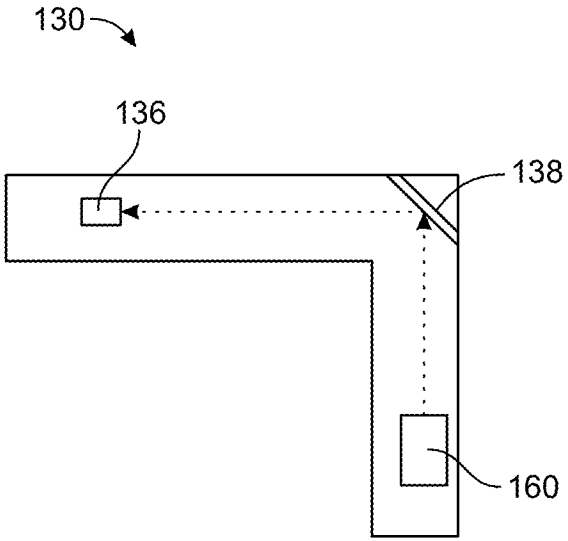
FIG. 5 illustrates a top-view schematic diagram of an example of a reflector system for a wireless system.

FIG. 5 illustrates a top-view schematic diagram of an example of a reflector system 130. The reflector system 130 includes a reflector 138 formed of a relatively large sized solid metal sheet that deflects a signal from transmitter 160 to receiver 136. While reflector 138 has high gain and connectivity, the large size of the reflector 138 means that it is not able to reflect to a large range of frequencies and therefore has limited bandwidth capabilities. The reflector 138 has a solid metallic surface and therefore acts as an almost perfect reflector. In some aspects, the reflector 138 does not have capability to reduce side lobes of a received signal. The reflector 138 does not have directivity and therefore, covers a limited area or field-of-view (FOV).

Rather than to use a large sized metallic sheet, the present disclosure provides for configurations having individual reflective tiles that may be patch antennas, meta-structures, such as metamaterials, or other configurations.

Figure 6:
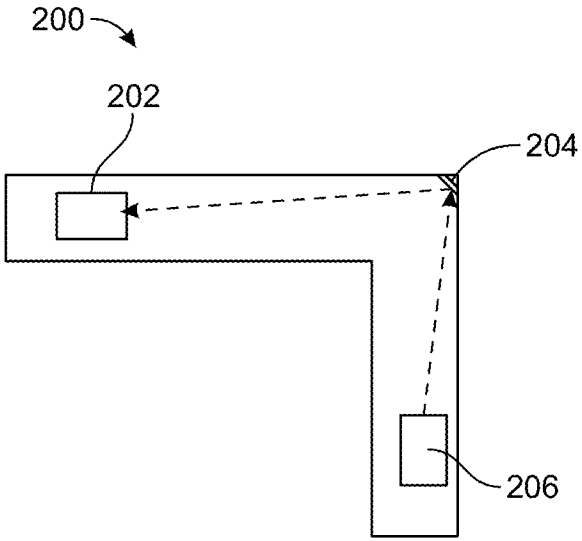
FIG. 6 illustrates a directed reflector system, according to implementations of the subject technology.

FIG. 6 illustrates a reflector system 200 having a directed reflect array 204, which may be passive or active. A passive array does not require electronics or other controls, as once in position it directs incident beams into a specific direction or directions. To change the direction(s) may require repositioning the entire directed reflect array 204. In comparison to the approach discussed in FIG. 5, the subject technology provides for directivity and high bandwidth due to the size and configuration of the individual tiles in the directed reflect array 204. This enables directivity with a simple design, which in many implementations is a patterned configuration. As illustrated in FIG. 6, the directed reflect array 204 is positioned between a transmitter 206 and receiver 202 to deflect a signal from the transmitter 206 to the receiver 202. The directed reflect array 204 has an array of reflector elements. The receiver 202 may be positioned in a target coverage area or may be in communication with another device capable of receiving signal information from the beam reflected by the directed reflect array 204. As depicted in FIG. 6, the beams are indicated by respective arrows to show the direction of the beams, however, radiation patterns may take any of a variety of shapes and forms, depending on the components of the reflector system 200, transmitter 206 and receiver 202, the directed reflect array 204, the size of the space within which the system operates, the materials and reflectivity of the area, and so forth. As illustrated in the comparison of FIGS. 5 and 6, the directed reflect array 204 is smaller in size than the reflector 138.

Figure 8:
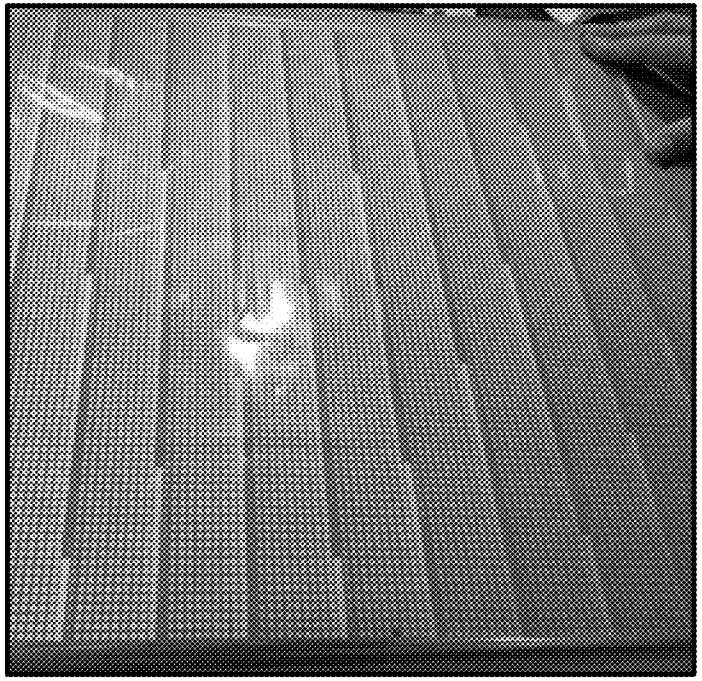
FIG. 8 illustrates an example of a directed reflect array in which one or more implementations of the subject technology may be implemented.
Figure 7:
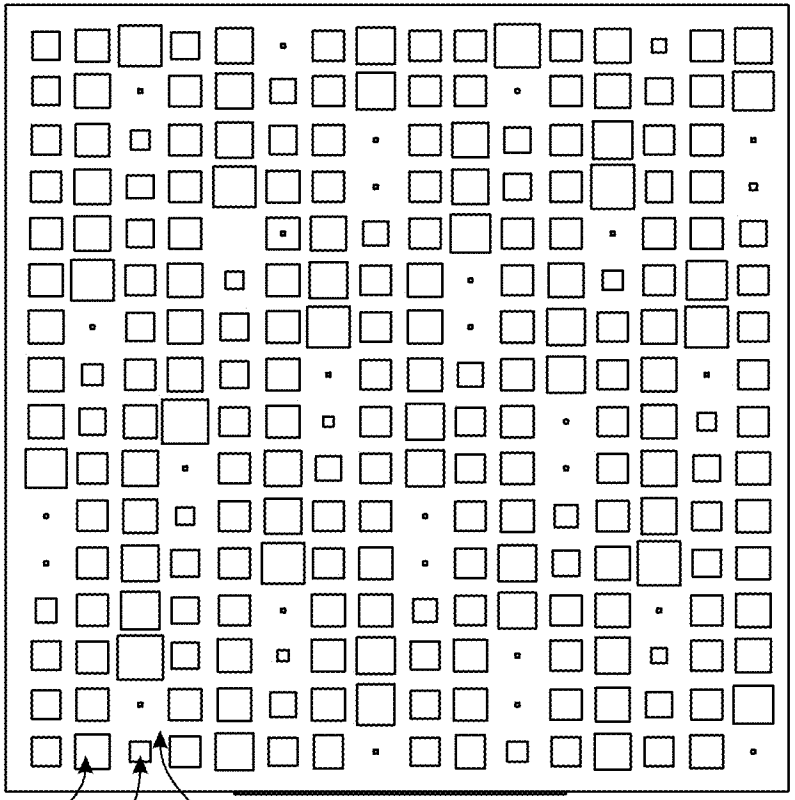
FIG. 7 illustrates a schematic diagram of a directed reflect array, according to implementations of the subject technology.

FIG. 7 illustrates a schematic diagram of a directed reflect array 208, according to implementations of the subject technology. The directed reflect array 208 is configured with various sized tiles, such as tile 210 and tile 212, each having different dimensions. In the directed reflect array 208, the tiles are configured in approximate column and row formation, however, alternate implementations may employ any of a variety of configurations. Directed reflect array 208 further includes spaces 214 that have no tile positioned thereon. The size of the tiles, the number of tiles, the shape of the tiles, and the configuration, including spatial areas, such as space 214, are determined according to the parameters of the environment, the FW network and the desired redirection. FIG. 8 illustrates an example of a directed reflect array 250 in which one or more implementations of the subject technology may be implemented.

Figure 9:
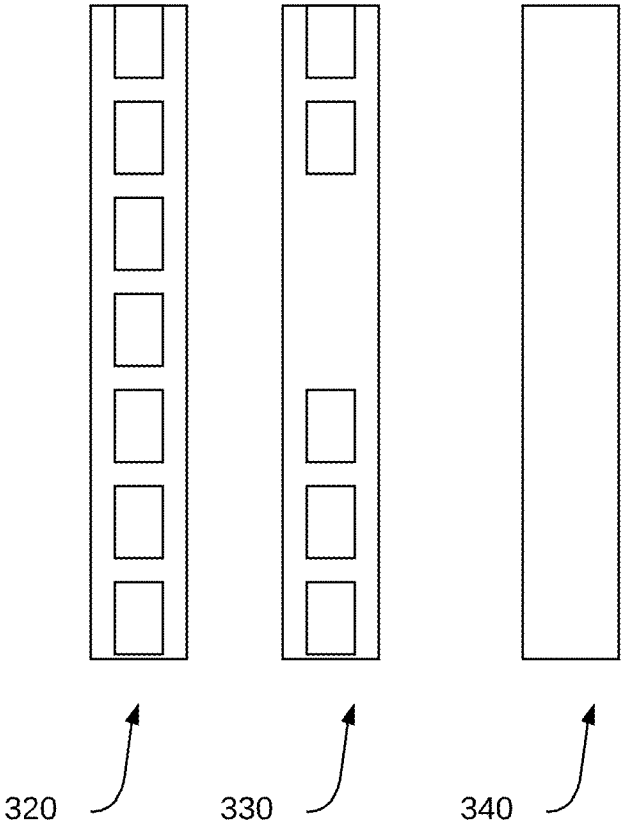
FIG. 9 illustrates design configurations for a directed reflect array, according to implementations of the subject technology.
Figure 9:
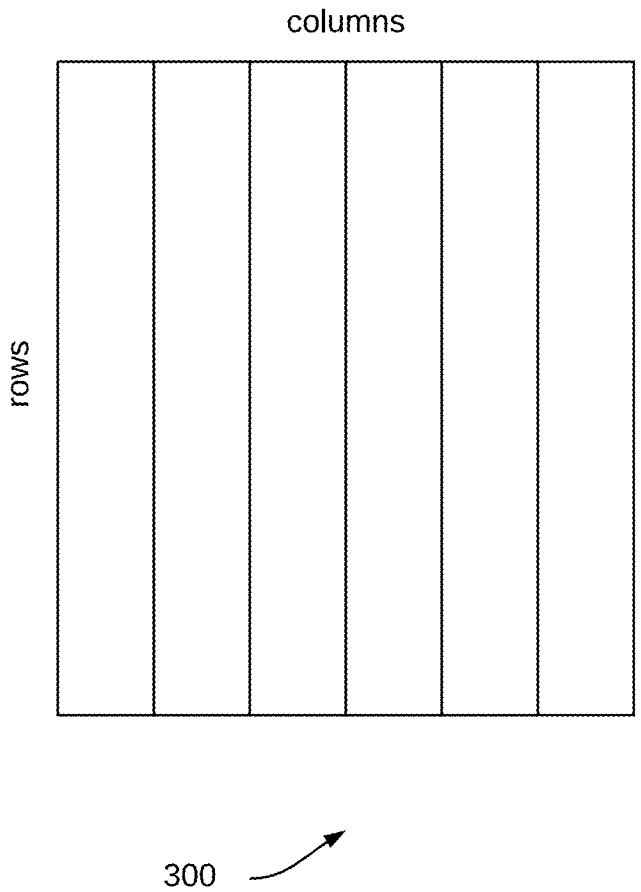

FIG. 9 illustrates details of a configuration 300 for a tiled reflect array, such as array 208. The configuration 300 has multiple columns (e.g., 320, 330, 340) within which tiles are positioned. In some examples, column 320 is filled with same sized tiles. In other examples, column 330 has same sized tiles and spaces therebetween. In still other examples, column 340 is a column of spaces. In some aspects, the column 340 may be interposed between columns that correspond to the column 330 or to the column 340. Other columns may have a variety of shapes, shapes of different sizes, and other configurations to achieve the desired reflection.

Figure 10:
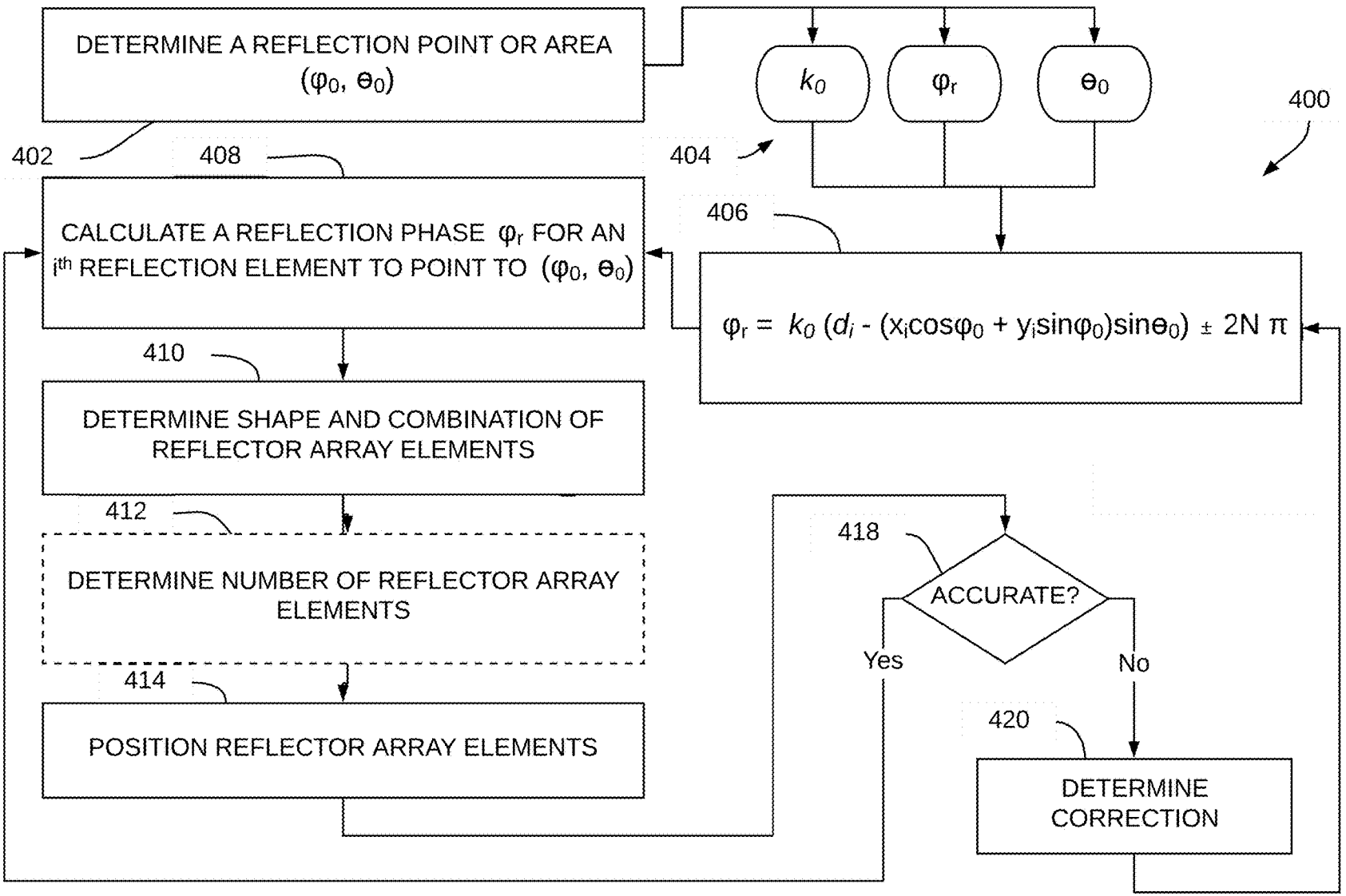
FIG. 10 illustrates a flow chart of an example process of designing and calibrating a directed reflect array, according to implementations of the subject technology.

FIG. 10 illustrates a flow chart of an example process 400 of designing and calibrating a directed reflect array, according to implementations of the subject technology. For explanatory purposes, the example process 400 is primarily described herein with reference to the directed reflect array 204 of FIG. 6 and to the electronic system 1900 of FIG. 19; however, the example process 400 is not limited to the electronic system 1900 of FIG. 19, and the example process 400 can be performed by the directed reflect array 208 of FIG. 7. Further for explanatory purposes, the blocks of the example process 400 are described herein as occurring in serial, or linearly. However, multiple blocks of the example process 400 can occur in parallel. In addition, the blocks of the example process 400 can be performed in a different order than the order shown and/or one or more of the blocks of the example process 400 are not performed.

The process 400 starts, at step 402, by determining a reflection point or reflection area. This area is defined by the angular relation to boresight of the directed reflect array, which is a beam directed perpendicular to the x and y directions of the plane, and along the z axis. Next, at step 404, the process 400 extracts values, such as the free space propagation constant, $k_0$, the reflection phase, $\varphi_r$, and the reflection elevation, $\theta_0$. Subsequently, at step 406, the process 400 determines an equation for the reflection phase, which can be expressed as:

$$\varphi_r = k_0(d_i - (x_i \cos \varphi_0 + y_i \sin \varphi_0)\sin \theta_0) \pm 2N\pi \quad \text{(Eq. 1)}$$

wherein $k_0$ is free space propagation constant, $d_i$ is the distance from the phase center of the transmitter to the center of the $i^{th}$ element, N is an integer, and the target reflection point is identified by an angle in azimuth ($\varphi_0$) and an angle in elevation ($\theta_0$) from the directed reflect array to the target reflection point. Using these values, the process, at step 408, calculates the reflection phase, $\varphi_r$, for reflector element (i) to radiate to the reflection point. The calculation identifies a desired or required reflection phase $\varphi_r$ by $i^{th}$ element on the xy plane to point the array beam to ($\varphi_0$, $\theta_0$). This formula and equation may further include weights to adapt and adjust specific tiles or sets of tiles. In some implementations, the directed reflection is a composition of the entire array of tiles, or a subarray of the tiles, in which each tile contributes to that directed reflection beam. In some implementations, a reflect array may include multiple subarrays allowing redirection of a received signal in more than one direction.

Next, at step 410, the process 400 determines the shape and combination of reflect array elements, referred to herein as tiles. Subsequently, at step 412, the process 400 determines the number of tiles. Next, at step 414, the process 400 determines the positions of the reflect array elements. Subsequently, at step 418, the process 400 determines whether the configuration is accurate. If the configuration is accurate, the process 400 proceeds back to step 408, where the processing continues for the next tile. Otherwise, the process 400 proceeds to step 420. At step 420, the process 400 determines a correction and recalculates the reflection phase. A correction may include an adjustment to the weighting of the tiles, or to add a tapering formulation and so forth.

Figure 11:
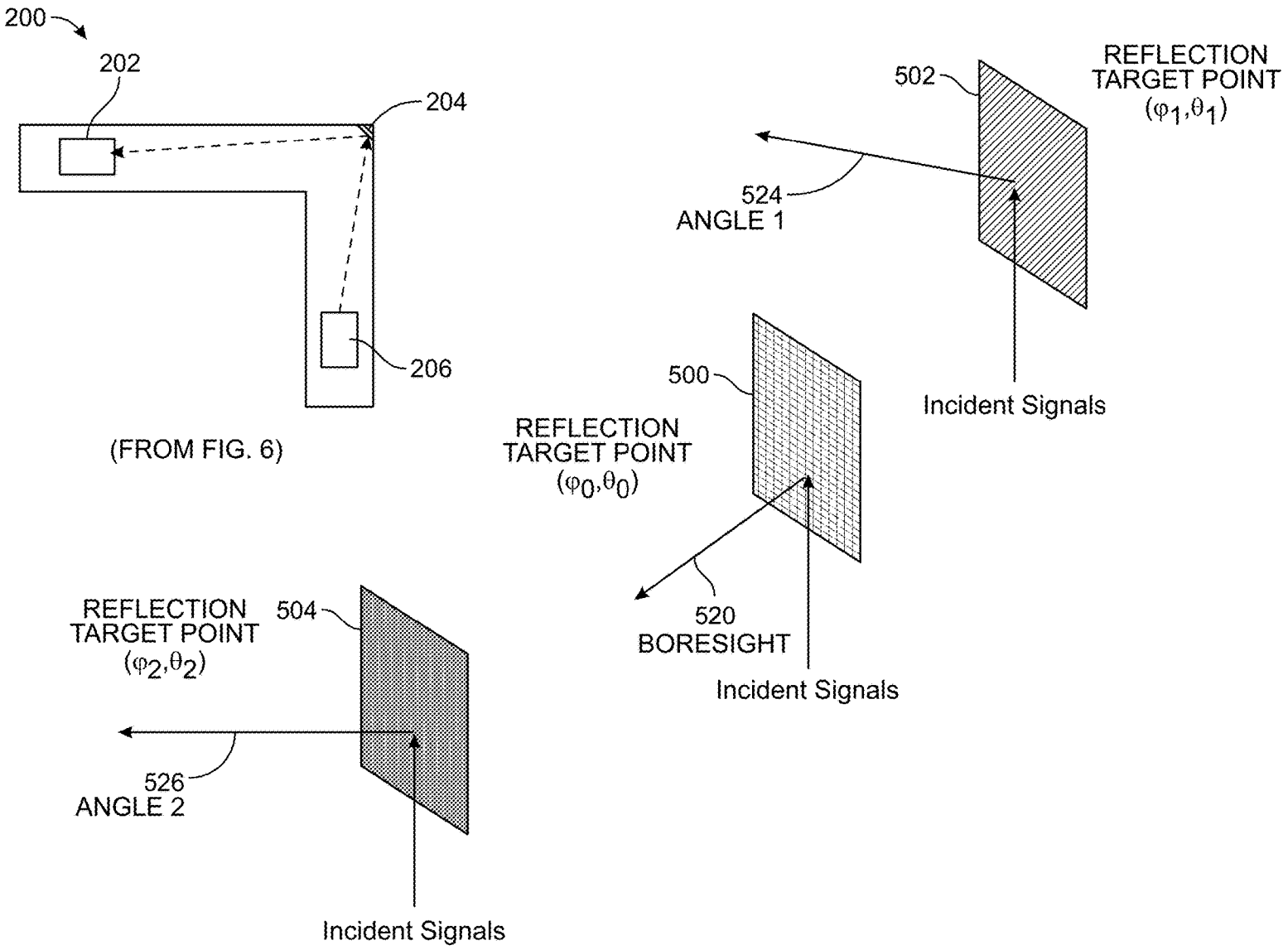
FIGS. 11 and 12 illustrate operation of a directed reflect array configured for different reflection angles, according to implementations of the subject technology.
Figure 12:
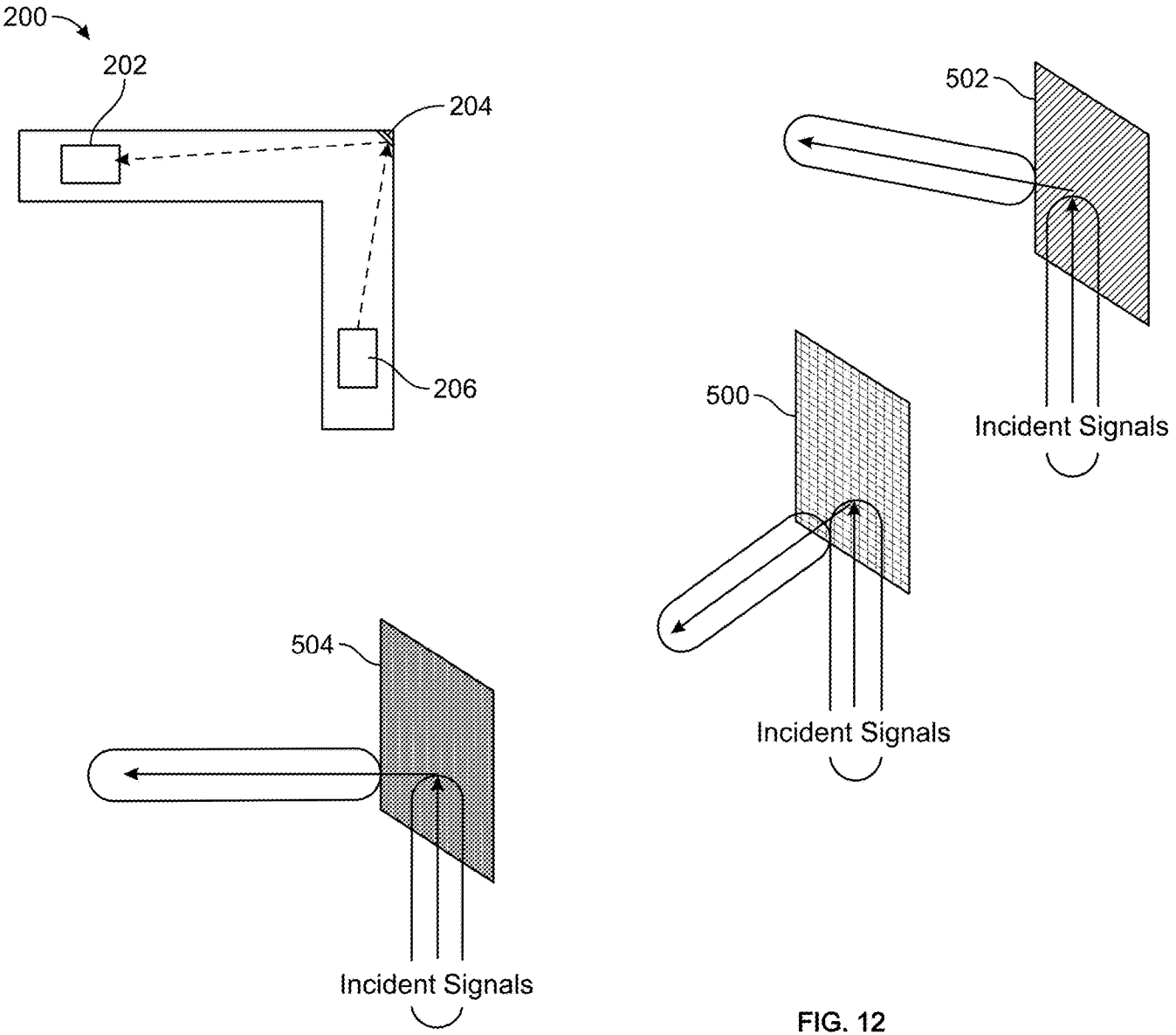

FIG. 11 illustrates reflections from the reflect array 204 of FIG. 6, in which several different reflect array configurations (e.g., 500, 502, 504) are illustrated. Reflect array 500 reflects incident beams to the boresight of the plane of the reflect array 500. In some implementations, the reflect array 500 may be configured on a non-linear surface. The reflect array 502 has a reflection having an angle 1 measured from boresight, and the reflect array 504 has a reflection having an angle 2 from the boresight. The reflection target point or area for each reflect array is given as illustrated in FIG. 11. A further detail for clarity of the reader is provided by the beams illustrated along the directions in FIG. 12.

Figure 13:
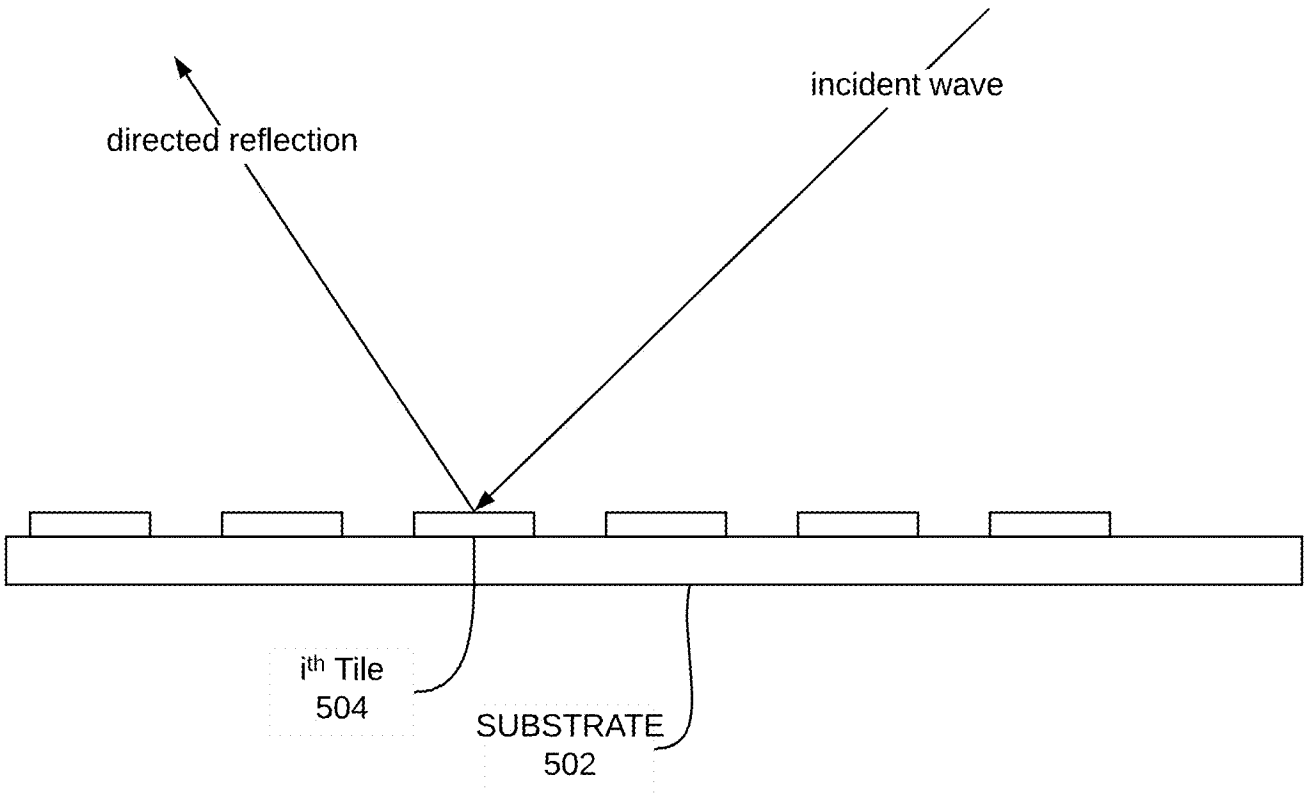
FIG. 13 illustrates reflections of an individual tile in a directed reflect array, according to implementations of the subject technology.

FIG. 13 illustrates reflections of an individual tile in a directed reflect array, according to implementations of the subject technology. The directed reflect array includes a substrate 502 having tiles configured thereon, such as tile 504. As illustrated, an individual tile 504, identified as an $i^{th}$ tile, has a specific reflection behavior as determined by the process 400 of FIG. 10. This reflection behavior is determined so that each tile and space in the substrate 502 contributes to the reflection pattern.

Figure 14:
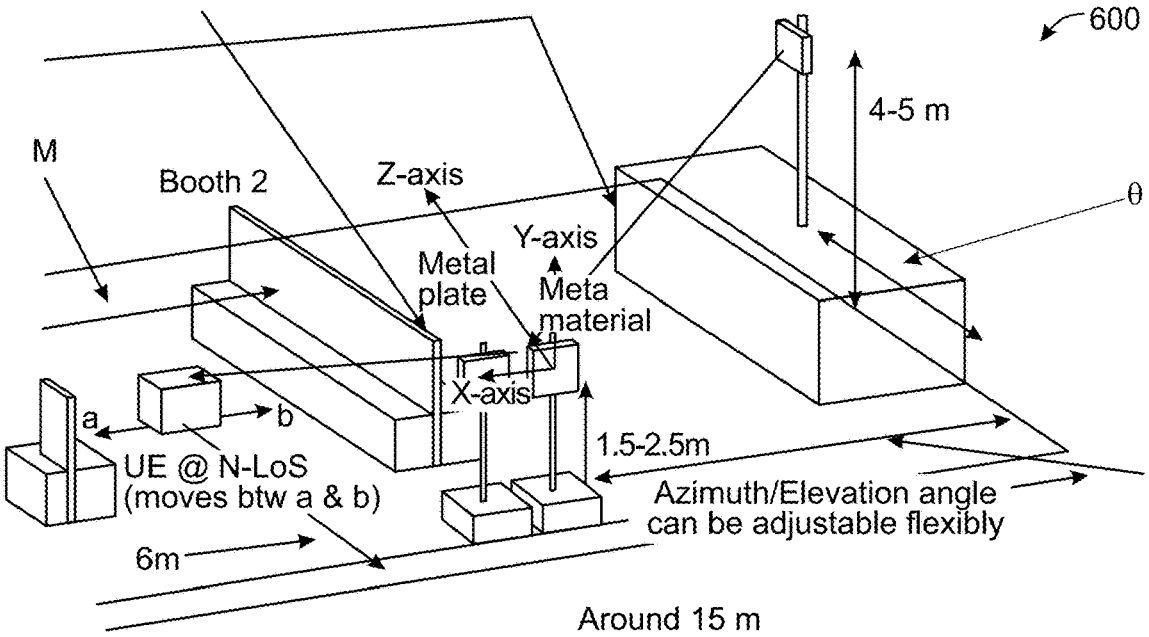
FIGS. 14 and 15 illustrate configurations of portions of a directed reflect array, according to implementations of the subject technology.
Figure 14:
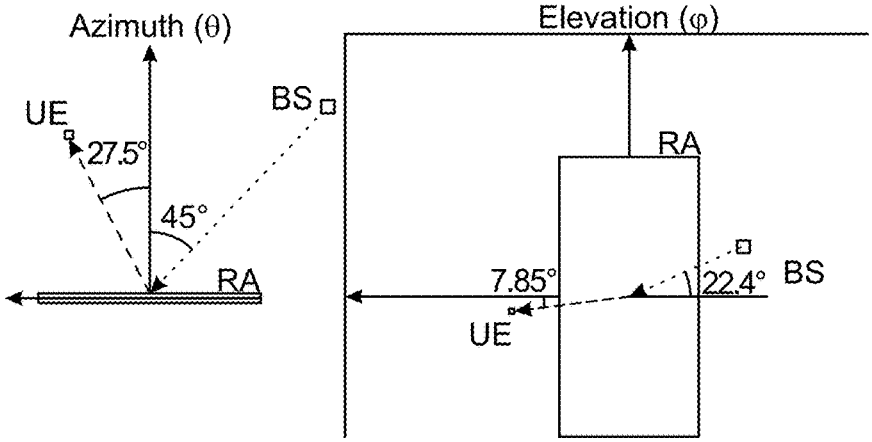
Figure 15:
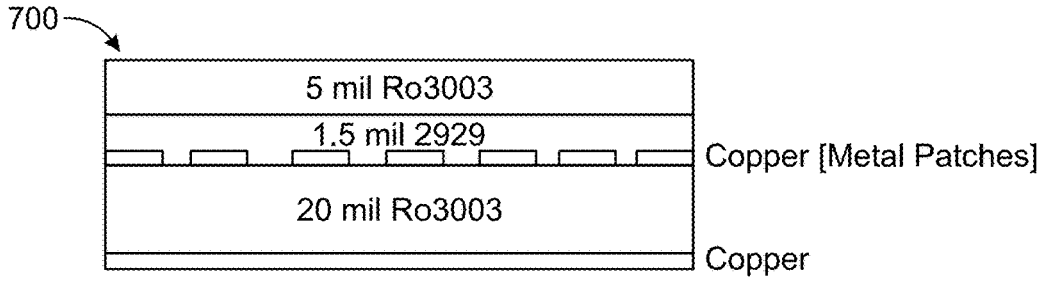

FIG. 14 conceptually illustrates an indoor environment 600 having dimensions of a directed reflect array. FIG. 15 provides further details as to a configuration of a directed reflect array 700. In some implementations, the directed reflect array 700 includes multiple layers of conductive and non-conductive material. For example, a signal layer with patterned patches that contain a conductive material, such as Copper, can be interposed between two non-conductive layers to receive isolation. A ground plane depicted as the bottom layer can include the same conductive material as that of the signal layer.

Figure 17B:
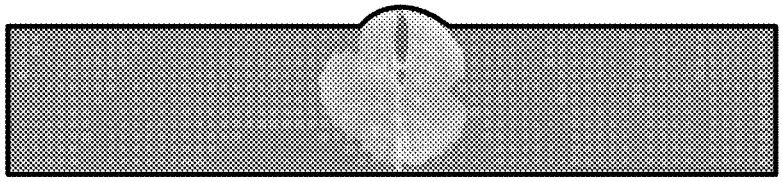
FIGS. 17A and 17B illustrate a radiation pattern from a directed reflect array, according to implementations of the subject technology.
Figure 17A:
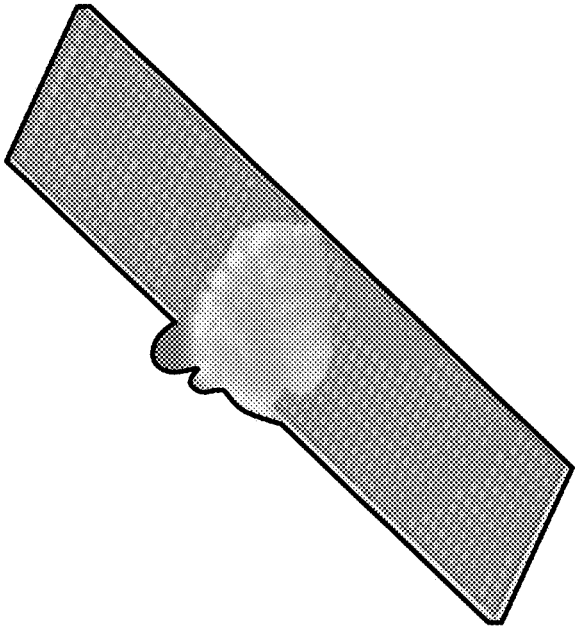
Figure 16:
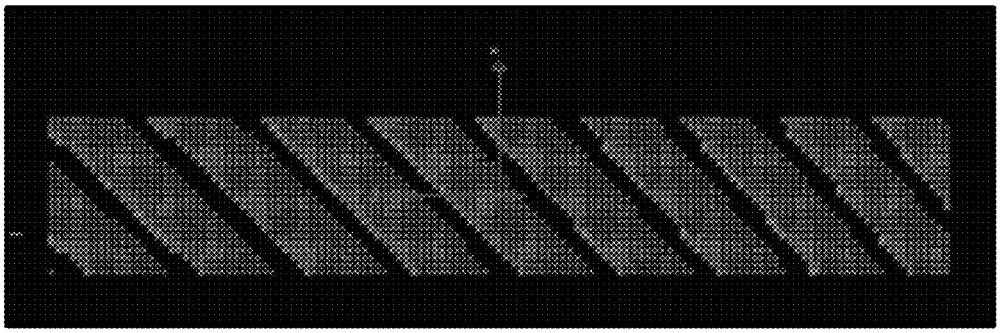
FIG. 16 illustrates a configuration of portions of a directed reflect array, according to implementations of the subject technology.

FIG. 16 conceptually illustrates an implementation of a directed reflect array 700, having different sized tiles and spaces. FIGS. 17A and 17B illustrate a radiation pattern from a directed reflect array, according to implementations of the subject technology. FIG. 17A illustrates a perspective-view of a directed reflect array 1700 and the radiation pattern resulting from its reflections. FIG. 17B illustrates a top-view of a directed reflect array 1750 and the radiation pattern resulting from its reflections.

Figure 18:
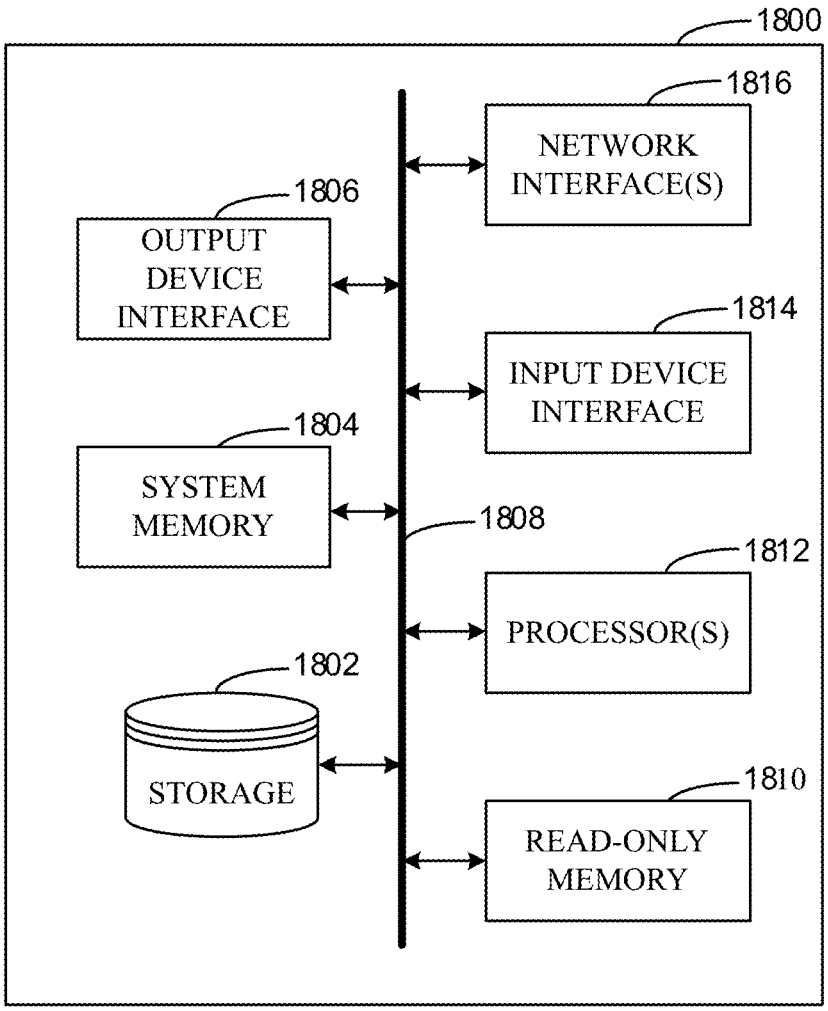
FIG. 18 conceptually illustrates an electronic system with which one or more implementations of the subject technology may be implemented.

FIG. 18 conceptually illustrates an electronic system 1800 with which one or more implementations of the subject technology may be implemented. The electronic system 1800, for example, can be a computer, a server, or generally any electronic device that executes a program to design and calibrate a directed reflect array by computer modeling. Such an electronic system includes various types of computer readable media and interfaces for various other types of computer readable media. The electronic system 1800 includes a bus 1808, one or more processing unit(s) 1812, a system memory 1804 (and/or buffer), a read-only memory (ROM) 1810, a permanent storage device 1802, an input device interface 1814, an output device interface 1806, and one or more network interfaces 1816, or subsets and variations thereof.

The bus 1808 collectively represents all system, peripheral, and chipset buses that communicatively connect the numerous internal devices of the electronic system 1800. In one or more implementations, the bus 1808 communicatively connects the one or more processing unit(s) 1812 with the ROM 1810, the system memory 1804, and the permanent storage device 1802. From these various memory units, the one or more processing unit(s) 1812 retrieves instructions to execute and data to process in order to execute the processes of the subject disclosure. For example, the processing unit(s) 1812 can execute instructions that perform one or more processes, such as processes 300 and 700. The one or more processing unit(s) 1812 can be a single processor or a multi-core processor in different implementations.

The ROM 1810 stores static data and instructions that are needed by the one or more processing unit(s) 1812 and other modules of the electronic system 1800. The permanent storage device 1802, on the other hand, may be a read-and-write memory device. The permanent storage device 1802 may be a non-volatile memory unit that stores instructions and data even when the electronic system 1800 is off. In one or more implementations, a mass-storage device (such as a magnetic or optical disk and its corresponding disk drive) may be used as the permanent storage device 1802.

In one or more implementations, a removable storage device (such as a floppy disk, flash drive, and its corresponding disk drive) may be used as the permanent storage device 1802. Like the permanent storage device 1802, the system memory 1804 may be a read-and-write memory device. However, unlike the permanent storage device 1802, the system memory 1804 may be a volatile read-and-write memory, such as random access memory. The system memory 1804 may store any of the instructions and data that one or more processing unit(s) 1812 may need at runtime. In one or more implementations, the processes of the subject disclosure are stored in the system memory 1804, the permanent storage device 1802, and/or the ROM 1810. From these various memory units, the one or more processing unit(s) 1812 retrieves instructions to execute and data to process in order to execute the processes of one or more implementations.

The bus 1808 also connects to the input and output device interfaces 1814 and 1806. The input device interface 1814 enables a user to communicate information and select commands to the electronic system 1800. Input devices that may be used with the input device interface 1814 may include, for example, alphanumeric keyboards and pointing devices (also called "cursor control devices"). The output device interface 1806 may enable, for example, the display of images generated by electronic system 1800. Output devices that may be used with the output device interface 1806 may include, for example, printers and display devices, such as a liquid crystal display (LCD), a light emitting diode (LED) display, an organic light emitting diode (OLED) display, a flexible display, a flat panel display, a solid state display, a projector, or any other device for outputting information. One or more implementations may include devices that function as both input and output devices, such as a touch-screen. In these implementations, feedback provided to the user can be any form of sensory feedback, such as visual feedback, auditory feedback, or tactile feedback; and input from the user can be received in any form, including acoustic, speech, or tactile input.

Finally, as shown in FIG. 18, the bus 1808 also couples the electronic system 1800 to a network (not shown) and/or to one or more devices through the one or more network interface(s) 1816, such as one or more wireless network interfaces. In this manner, the electronic system 1800 can be a part of a network of computers (such as a local area network ("LAN"), a wide area network ("WAN"), or an Intranet, or a network of networks, such as the Internet. Any or all components of the electronic system 1800 can be used in conjunction with the subject disclosure.

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

Furthermore, to the extent that the term "include," "have," or the like is used in the description or the claims, such term is intended to be inclusive in a manner similar to the term "comprise" as "comprise" is interpreted when employed as a transitional word in a claim.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

While this specification contains many specifics, these should not be construed as limitations on the scope of what may be claimed, but rather as descriptions of particular implementations of the subject matter. Certain features that are described in this specification in the context of separate implementations can also be implemented in combination in a single implementation. Conversely, various features that are described in the context of a single implementation can also be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

The subject matter of this specification has been described in terms of particular aspects, but other aspects can be implemented and are within the scope of the following claims. For example, while operations are depicted in the drawings in a particular order, this should not be understood as requiring that such operations be performed in the particular order shown or in sequential order, or that all illustrated operations be performed, to achieve desirable results. The actions recited in the claims can be performed in a different order and still achieve desirable results. As one example, the processes depicted in the accompanying figures do not necessarily require the particular order shown, or sequential order, to achieve desirable results. Moreover, the separation of various system components in the aspects described above should not be understood as requiring such separation in all aspects, and it should be understood that the described program components and systems can generally be integrated together in a single hardware product or packaged into multiple hardware products. Other variations are within the scope of the following claim.

What is claimed is:

1. A directed reflect array, comprising:

a substrate; and a plurality of reflective tiles of different dimensions disposed on the substrate, wherein the plurality of reflective tiles are individually arranged to produce a directed radiation pattern that is directed toward a target reflection point based at least on a reflection phase of one or more reflective tiles in the plurality of reflective tiles.

2. The directed reflect array of claim 1, wherein the plurality of reflective tiles includes spaces between reflective tiles, and wherein the spaces have different dimensions.

3. The directed reflect array of claim 2, wherein each tile of the plurality of reflective tiles and each space between the reflective tiles are dimensioned and positioned to achieve a specific phase shift of an incident wave thereon.

4. The directed reflect array of claim 1, wherein the plurality of reflective tiles includes a first column comprising first tiles with equivalent dimensions and equivalent spacing between the first tiles, a second column comprising second tiles with equivalent dimensions and different spacing between the second tiles, and a third column excluding tiles, and wherein the third column is arranged adjacent to the first column and the second column.

5. A method of configuring a directed reflect array, comprising:

determining a target reflection point;

calculating a first reflection phase for at least one of a plurality of reflection elements of the directed reflect array;

determining an arrangement of the plurality of reflection elements with the calculated first reflection phase;

positioning the plurality of reflection elements in the directed reflect array;

determining whether a configuration of the directed reflect array with the positioned plurality of reflection elements is accurate; and calculating a second reflection phase for at least another of the plurality of reflection elements of the directed reflect array when the configuration of the directed reflect array is determined to be accurate.

6. The method of claim 5, further comprising determining a correction of the calculated first reflection phase when the configuration of the directed reflect array is determined not to be accurate.

7. The method of claim 5, wherein the first reflection phase is calculated with an equation defined as $\varphi_r = k_0(d_i - (x_i \cos\varphi_0 + y_i \sin\varphi_0)\sin\theta_0) \pm 2N\pi$, where $k_0$ is the speed of light, $d_i$ is the distance from the transmitter to the $i^{th}$ element, N is an integer, and the target reflection point is identified by an angle in azimuth ($\varphi_0$) and an angle in elevation ($\theta_0$) from the directed reflect array to the target reflection point.

8. The method of claim 5, wherein determining the arrangement of the plurality of reflection elements comprises determining a number of reflect array elements with the calculated first reflection phase.

9. The method of claim 5, further comprising calibrating the directed reflect array that improves an accuracy of the directed reflect array.

10. The method of claim 5, wherein calculating the first reflection phase comprises applying weights to a calculation of at least one reflection element in the plurality of reflection elements.

11. A wireless network system, comprising:

a reflect array comprising a plurality of reflective meta-structures of different dimensions, each of the plurality of reflective meta-structures having a reflection phase; and a control module configured to adjust the reflection phase of each of the plurality of reflective meta-structures, wherein the reflection phase of a corresponding reflective meta-structure determines a direction of a reflection pattern in response to an incident wave impinging on the reflect array.

12. The wireless network system of claim 11, further comprising a phase control component coupled to at least one of the reflective meta-structures.

13. The wireless network system of claim 11, wherein the plurality of reflective meta-structures are metamaterial unit cells.

14. The wireless network system of claim 11, wherein the plurality of reflective meta-structures include conductive patches.

15. The wireless network system of claim 11, wherein the plurality of reflective meta-structures form the reflect array configured to reflect from a transmission source to a target reflection point.

16. The wireless network system of claim 15, further comprising a fixed wireless transceiver configured to communicate with a communication network.

17. The wireless network system of claim 11, wherein the reflect array further comprises a substrate, wherein the plurality of reflective meta-structures are disposed on the substrate, and wherein the plurality of reflective meta-structures are individually arranged to produce a directed radiation pattern that is directed toward a target reflection point based at least on the reflection phase of one or more reflective meta-structures in the plurality of reflective meta-structures.

18. The wireless network system of claim 11, wherein the plurality of reflective meta-structures includes meta-structures of different dimensions.

19. The wireless network system of claim 11, wherein the plurality of reflective meta-structures includes spaces between reflective meta-structures, wherein the spaces have different dimensions, and wherein each reflective meta-structure of the plurality of reflective meta-structures and space between the reflective meta-structures are dimensioned and positioned to achieve a specific phase shift of an incident wave thereon.

20. The directed reflect array of claim 1, wherein at least one of the plurality of reflective tiles comprises multiple layers of conductive and non-conductive material.

* * * * *